US012459729B2

(12) United States Patent
Untch

(10) Patent No.: US 12,459,729 B2
(45) Date of Patent: Nov. 4, 2025

(54) DEVICE FOR STORING AND TRANSPORTING BULK MATERIAL, IN PARTICULAR PHARMACEUTICAL BULK MATERIAL, AS WELL AS A METHOD FOR FILLING A DEVICE OF THIS KIND WITH SAID BULK MATERIAL AND FOR EMPTYING A DEVICE FILLED WITH SAID BULK MATERIAL

(71) Applicant: Andocksysteme G. Untch GmbH, Badenweiler (DE)

(72) Inventor: Günter Untch, Badenweiler (DE)

(73) Assignee: Andocksysteme G. Untch GmbH, Badenweiler (DE)

( * ) Notice: Subject to any disclaimer, the term of this patent is extended or adjusted under 35 U.S.C. 154(b) by 776 days.

(21) Appl. No.: 17/252,179

(22) PCT Filed: Jun. 14, 2019

(86) PCT No.: PCT/EP2019/065671
§ 371 (c)(1),
(2) Date: Dec. 14, 2020

(87) PCT Pub. No.: WO2019/238920
PCT Pub. Date: Dec. 19, 2019

(65) Prior Publication Data

US 2021/0253337 A1 Aug. 19, 2021

(30) Foreign Application Priority Data

Jun. 15, 2018 (DE) ..... 20 2018 103 391.3

(51) Int. Cl.
*B65D 88/16* (2006.01)
*B65D 88/02* (2006.01)
*B65D 90/54* (2006.01)

(52) U.S. Cl.
CPC ..... *B65D 88/1618* (2013.01); *B65D 88/022* (2013.01); *B65D 90/54* (2013.01); *B65D 2588/165* (2013.01)

(58) Field of Classification Search
CPC .. B65D 88/1618; B65D 88/022; B65D 90/54; B65D 2588/165; B65D 21/0219; B65D 43/0218; B65D 1/22
(Continued)

(56) References Cited

U.S. PATENT DOCUMENTS 2,751,073 A * 6/1956 Sheeran ..... B65D 51/00 206/524.5
3,163,311 A 12/1964 Cornelius
(Continued)

FOREIGN PATENT DOCUMENTS

AU 2013201046 A1 * 9/2014 ..... B65D 88/1618
DE 10 2018 105 676 9/2019
(Continued)

OTHER PUBLICATIONS

English translation of WO 2016142432 (Year: 2016).*
(Continued)

*Primary Examiner* — Don M Anderson
*Assistant Examiner* — Eric C Baldrighi
(74) *Attorney, Agent, or Firm* — Akerman LLP; Peter A. Chiabotti

(57) ABSTRACT

A device for storing and transporting a bulk material, in particular a pharmaceutical bulk material, comprising a base container and at least one connection body detachably connectable with the base container, wherein the base container and the connection body in the connected state form a sealing section with which the base container and the connection body are connectable or are connected gas-tight with one another. A method for filling such device with this
(Continued)

bulk material and for emptying a device filled with this bulk material as well as the use of such device for storing and transporting a pharmaceutical bulk material.

19 Claims, 12 Drawing Sheets

(58) Field of Classification Search
USPC ..... 220/530
See application file for complete search history.

(56) References Cited

U.S. PATENT DOCUMENTS

| | | | | |
|---|---|---|---|---|
| 5,092,683 | A * | 3/1992 | Wurr | B65D 88/165 383/105 |
| 5,192,134 | A * | 3/1993 | Polett | B65D 88/1668 383/41 |
| 9,404,586 | B2 | 8/2016 | Diel | |
| 2009/0090721 | A1 | 4/2009 | Buisson et al. | |
| 2009/0194189 | A1 | 8/2009 | Bordere et al. | |
| 2010/0155281 | A1 | 6/2010 | Tuominen et al. | |
| 2012/0124789 | A1* | 5/2012 | Untch | B65B 39/00 24/406 |
| 2013/0036711 | A1* | 2/2013 | Scudder | B65D 90/048 220/666 |
| 2014/0190987 | A1 | 7/2014 | Brundick et al. | |
| 2014/0314527 | A1* | 10/2014 | Untch | B65G 69/18 414/292 |
| 2015/0122835 | A1 | 5/2015 | Gonzalez et al. | |
| 2016/0122123 | A1* | 5/2016 | Han | B65D 88/022 206/598 |
| 2017/0073126 | A1* | 3/2017 | Comer | B65D 21/0206 |
| 2018/0057287 | A1* | 3/2018 | Snape | B65B 69/0083 |

FOREIGN PATENT DOCUMENTS

| | | | | |
|---|---|---|---|---|
| EP | 0672590 | | 9/1995 | |
| GB | 2456059 | A | 7/2009 | |
| WO | 2006100876 | A1 | 9/2006 | |
| WO | 2010118817 | A1 | 10/2010 | |
| WO | 2016/142432 | | 9/2016 | |
| WO | WO-2016142432 | A1 * | 9/2016 | B65G 9/183 |

OTHER PUBLICATIONS

Patent Cooperation Treaty, "International Search Report," and English translation of international search, issued in International Patent Application No. PCT/EP2019/065671, date Dec. 12, 2019, document of 9 pages.

Nov. 21, 2023 Invitation to pay Search Fees with Search Report (Communication under Rule 164(2)(a) EPC) issued in corresponding European Application No. 19731254.9 (with machine generated English language translation).

EPO Search Report, issued in EP Appln No. 19731254.9, Jan. 29, 2024.

* cited by examiner

DEVICE FOR STORING AND TRANSPORTING BULK MATERIAL, IN PARTICULAR PHARMACEUTICAL BULK MATERIAL, AS WELL AS A METHOD FOR FILLING A DEVICE OF THIS KIND WITH SAID BULK MATERIAL AND FOR EMPTYING A DEVICE FILLED WITH SAID BULK MATERIAL

CROSS REFERENCE TO RELATED APPLICATIONS

This application is a § 371 National Phase of PCT/EP2019/065671, filed Jun. 14, 2019, which claims priority to German Patent Application No. 20 2018 103 391.3, filed Jun. 15, 2018.

The present application relates to a device for storing and transporting bulk material, in particular pharmaceutical bulk material. The application relates further to a method for filling such a device with this bulk material and for emptying a device filled with this bulk material as well as the use of such a device for storing and transporting pharmaceutical bulk material.

BACKGROUND

For various reasons, handling pharmaceutical bulk materials that are frequently toxic represents a challenge. Depending on the toxicity of the bulk material, even small quantities can be a danger to the environment and to all living beings coming into contact with them, in particular to persons assigned to handle them. But the bulk materials themselves must not come into contact with substances in the environment since contaminations caused thereby can lead to adverse changes of the bulk materials. Within this context should be mentioned in particular the transfer of bulk materials from one container to another. Bulk materials are frequently delivered in flexible containers from which they must be moved, for example, into a processing chamber where they undergo further treatment. Since in this event the flexible container as well as also the processing chamber must be opened, the risk of contamination described above is herein especially high.

Containers used for the handling of the bulk materials have to be cleaned after use involving costly and time-consuming effort. Traces of bulk materials of a first type, that are stored in the containers before the cleaning, must not come into contact with bulk materials of a second type after the cleaning since this can also entail contaminations. Since the requirements made of the cleaning process are very high, the cleaning is highly time- and cost-intensive.

SUMMARY

The present application therefore addresses the problem of specifying a device and its use for storing and transporting a bulk material, which enables the simple and simultaneously safe handling and prevents contaminations. The device is to be flexibly adaptable to the particularities of the bulk material to be processed, in particular with respect to the type and manner in which the bulk material is to be processed and with respect to the toxicity of the bulk material. Moreover, the necessity of cleaning is to be omitted. The present application addresses furthermore the problem of providing a method for filling and emptying such a device which enables the simple and simultaneously safe handling and which prevents contaminations.

One embodiment relates to a device for storing and transporting bulk material, in particular a pharmaceutical bulk material, comprising a base container and at least one connection body connectable with the base container, wherein after they are connected, the base container and the connection body form a sealing section by means of which the base container and the connection body are connectable, or are connected, such that they are gas-tight.

The base body can serve for holding the bulk material, while the connection body can be a part of a supplying and/or emptying facility. It is technically impossible to seal the base container against the connection body in such manner that absolutely no gas can pass through the sealing section. To this extent the connection body and the base container are already connected gas-tight if within one day, preferably within 10 days, no more than 1 $cm^3$ can pass through the sealing section.

Based on the fact that the base container and the connection body can be connected gas-tight, the risk of contamination can be reduced to an acceptable level depending on the bulk material.

According to a further implementation, the connection body is developed as a closing cover. The closing cover can be especially utilized to seal the base container, in which the bulk material is received, gas-tight during transport and while being stored. Hereby is prevented that the bulk material can escape uncontrolled from the base container.

In a further developed embodiment, the cover can be implemented such that a multiplicity of base containers is stackable when the cover is connected with the base container. In this embodiment the cover is formed such that the bottom of the base container can be introduced into the cover such that the positioning of the base container on the cover is carried out. Moreover, the base containers introduced into the cover is being stabilized such that several base containers can be stacked without there being any risk of slipping and falling-off.

In a further developed embodiment, the connection body can comprise a gas-tight sealable filling connection for introducing and emptying the bulk material, on which a mating connection of a supplying and/or emptying facility can be connected gas-tight. When connected, the filling connection and the mating connection can form a double flap as described, for example, in WO2016/142432 A1. Such double flaps have the advantage that they can be readily opened and closed only when connected. The external surfaces of the double flaps that are accessible when separated cannot be reached by the bulk materials. To this extent, contaminations are prevented. Moreover, when opened, the double flaps offer only little resistance to the bulk material such that the transfer, for example from the base container into the supplying and/or emptying facility, or conversely, is not affected negatively. Such double flaps are also denoted as primary interfaces.

In a further embodiment, the filling connection can be closable by means of a protective cover. The protective cover offers additional protection against contaminations and can, moreover, be utilized as an indication of the base container being filled or empty. This can take place, for example, by the respective coloring of the protective cover. A signal can hereby be given of whether the base container is filled or emptied.

A further developed embodiment is distinguished thereby that the device comprises at least one wheeled transporter onto which one or several of the base containers can be placed. The wheeled transporter can be shaped similar to the cover such that the bottom of the base container that is placed directly onto the wheeled transporter is stabilized by the latter. It is consequently prevented that the base container during the transporting could fall off the wheeled transporter and be damaged. The feasibility of employing a wheeled transporter simplifies the handling of the base container.

According to a further embodiment, the device comprises at least one pallet onto which one or several of the base containers can be placed. The feasibility of employing a pallet also facilitates the handling especially when a multiplicity of base containers is to be transported. The pallet can herein be shaped such that tipping over and/or sliding of the base containers from the pallet are prevented. The pallet can, for example, be equipped with at least one side wall and a cover wall such that an at least partially enclosed volume is generated into which the base containers can be introduced. The base containers can thus be transported, for example by a forklift, without incurring the risk of the base containers being damaged and the bulk material stored therein escaping.

A further embodiment is distinguished thereby that the device comprises an inverting frame connectable with the base container, with which the base containers can be rotated about a rotational axis. Especially when a base container is to be emptied, it is useful to rotate the base container about a rotational axis that extends substantially horizontally. To accomplish this, the inverting frame is connected with the base container such that the base container is securely retained in each rotational position. The inverting frame can be connected with a driving facility with which the base container can be rotated about the rotational axis. Herewith in particular the secure, safe and complete emptying of the base container is enabled.

According to a further embodiment, the device comprises at least one flexible receptacle, which can be clamped gas-tight into the sealing section, for receiving the bulk material. Depending on which bulk material is involved, it is transported and stored in flexible receptacles which are, for example, shaped in the form of synthetic bags of polyethylene. The reasons for this are in particular the simplified disposal since flexible receptacles in the emptied state take up markedly less volume than rigid base containers. In this embodiment the flexible receptacle can be clamped into the sealing section in which, for example, the base container is connected with the cover or the connection body. Even in the opened state of the flexible receptacle it is thus prevented that bulk materials can uncontrollably and unchecked escape across the sealing section.

In a further developed embodiment, the sealing section can comprise a first sealing contour formed by the base container and a second sealing contour formed by the connection body, which are in gas-tight contact on one another when connected. The use of a first sealing contour and a second sealing contour enables in comparatively simple manner to connect the base container and the connection body such that they are gas-tight. The first sealing contour and the second sealing contour can be shaped, in particular, such that they form an especially large sealing surface area when they are in contact on one another. Consequently, an especially gas-tight connection is provided which also effectively prevents the escaping of especially fine particles of the bulk material.

In a further developed embodiment, the flexible receptacle in the connected state can be clampable or be clamped between the first sealing and the second sealing contour. Thereby that the first sealing contour and the second sealing contour are developed such that the flexible receptacle can be clamped between them, in this case the escaping of especially fine particles of the bulk material is also prevented if the bulk material is delivered in the flexible receptacle.

In a further embodiment the device can comprise an adapter body with a first passage opening and a second passage opening, wherein the adapter body comprises in the region of the first passage opening a first sealing section and in the region of the second passage opening a second sealing section such that the adapter body is connectable gas-tight with the base container and/or gas-tight with the connection body.

For example, by means of the adapter body the capacity of the base container can be flexibly enlarged. Moreover, the adapter body can also be utilized to provide a connection to the supplying and/or emptying facility. The adapter body is conventionally also utilized in addition to the connection body. However, it is also feasible to utilize the adapter body instead of the connection body or to form the connection body as the adapter body according to this embodiment.

A further embodiment is distinguished thereby that the first sealing section comprises the first sealing contour and the second sealing section comprises the second sealing contour. In this embodiment the adapter body can also be effectively sealed such that even especially fine particles of the bulk material cannot uncontrollably reach into the environment.

According to a further embodiment, the device comprises a flexible first envelope and a flexible second envelope for guiding the bulk material, wherein the flexible first envelope and the flexible second envelope are detachably connectable with one another by means of a docking lock with the development of a cleared and closable opening. Such a docking lock is disclosed, for example, in DE 10 2018 105 676 A1, with which it is feasible to connect the first and the second envelope with one another and simultaneously provide an opening between the first and the second envelope. Like the flexible receptacle, the envelopes can be fabricated of a flexible synthetic material, for example, of polyethylene. The bulk material can pass through the opening, wherein the connection between the first and the second envelope is shaped such that an uncontrolled discharge of the bulk material into the environment is avoided.

A further embodiment is distinguished thereby that the flexible receptacle is detachably connectable with the first envelope or the second envelope utilizing the docking lock. The docking lock can be shaped such that not only the first envelope and the second envelope can be connected with one another in the above described manner. With the docking lock the flexible receptacle can also be connected with the first or the second envelope in order to achieve the above described effects. To this extent, the device in this embodiment can be operated highly flexibly.

According to a further embodiment, the first envelope, when the opening is cleared, the second envelope or the flexible receptacle encompass the sealing section of the connection body, the first sealing section of the adapter body or the second sealing section of the adapter body or the filling connection and/or the mating connection. In this embodiment the first envelope and the second envelope form a secondary interface which is disposed outside of the primary interface that is formed by the sealing section, by the first sealing section or by the second sealing section. In this embodiment additional safety is provided against the uncontrollable leaking of bulk material into the environment. In the event bulk material can escape from the primary interface, it is prevented from being able to escape into the environment by the first envelope and the second envelope. Neither the sealing section nor the primary interface can be implemented to be absolutely gas-tight. A certain spillage cannot be prevented employing acceptable technical expenditures. Depending on the bulk material, the achievable impermeability using acceptable technical expenditures can be acceptable.

Using the two envelopes is especially suitable for handling highly toxic bulk materials that have to be treated according to the so-called OEB 5 or OEB 6 standard ("Occupational Exposure Band"). According to the OEB 5 standard, the concentration of a specific material must not exceed maximally 1 $\mu g/m^3$ and in the OEB 6 standard maximally 200 $ng/m^3$. These requirements can be met with this embodiment.

In a further developed embodiment, the connection body can be connected with a supplying and/or emptying facility, with which the bulk material can be introduced into the base container or into the flexible receptacle or be removed from the base container or from the flexible receptacle. With the supplying and/or emptying facility, relatively large quantities of bulk material can be forwarded, for example by means of a compressed air transportation system, within a short period of time such that the base container or the flexible receptacle can be filled or emptied very rapidly.

In a further developed embodiment, the device can comprise an enclosure facility that encloses an interior volume into which the base container can be introduced. The enclosure facility serves in particular for the protection of an emptied base container in which residues of the bulk material may be found, which, in the event of damage to the base container, can uncontrollably escape into the environment. The enclosure facility is therefore in particular employed during the transport of an emptied base container especially when the emptied base container is to be disposed. The handling of the base container is hereby also facilitated and made safer.

In a further embodiment, the enclosure facility can comprise an enclosure container and an enclosure upper shell which can be connected gas-tight with one another. In this embodiment not only is the base container protected against damages but it is also enclosed so as to be gas-tight. Even if a certain quantity of the bulk material should escape from the emptied base container, it is prevented that the bulk material can uncontrollably reach into the environment.

A further developed embodiment is distinguished thereby that the base container, the connection body, the flexible receptacle, the adapter body, the enclosure container and/or the enclosure upper shell are fabricated of a synthetic material, in particular of polyethylene. The use of synthetic material makes it feasible, for one, to fabricate the listed components in large quantities at low cost, in particular when using the injection molding process. For another, the use of synthetic material is especially suitable for laying out said components for "single use" which are disposed of after use and in particular are incinerated. The synthetic material can be chosen such that the energy required for incineration is kept low in order to be able to keep the cost of disposal low.

One development of the application relates to a method for filling a device according to one of the preceding embodiments with a bulk material, comprising the following steps:

providing a base container to be filled or
providing a base container and a flexible receptacle to be filled, which is introducible or has been introduced into the base container,
providing a connection body which
- is connected with a supplying and/or emptying facility, and/or
- comprises a filling connection for introducing the bulk material, connecting the base container and the connection body gas-tight in the sealing section and/or
connecting a mating connection of the supplying and/or emptying facility to the filling connection,
supplying the bulk material in the desired quantity into the base container or into the flexible receptacle, and
separating the connection body from the base container or
separating the mating connection from the filling connection when the base container or the flexible receptacle has been filled with the desired quantity of bulk material.

By utilizing the method according to this development, the base container or the flexible receptacle can be filled with the bulk material in simple manner. Due to the fact that a gas-tight connection between the base container and the connection body can be provided, bulk materials can be processed according to OEB 4 standard according to which a concentration of up to 10 $\mu g/m^3$ is allowed.

In a further development the method comprises the following steps:

providing a base container to be filled,
providing a connection body which
- is connected with a supplying and/or emptying facility and/or
- comprises a filling connection for introducing the bulk material, providing a flexible first envelope and a flexible second envelope for guiding the bulk material,
gas-tight connecting the base container and the connection body in the sealing section and/or
connecting a mating connection of the supplying and/or emptying facility to the filling connection,
connecting the first envelope and the second envelope forming a cleared opening by means of a docking lock such that the sealing section and/or the filling connection and the mating connection is encompassed by the cleared opening,
supplying the bulk material in the desired quantity into the base container or into the flexible receptacle, and
separating the connection body from the base container or
separating the mating connection from the filling connection when the base container or the flexible receptacle has been filled with the desired quantity of bulk material and
separating the first envelope from the second envelope with the formation of a closed opening.

This implementation of the method enables the processing of bulk material which must be treated according to OEB 6 (maximum concentration 200 $ng/m^3$).

One development of the application relates to a method for emptying a device according to one of the preceding embodiments filled with a bulk material, comprising the following steps:

providing a base container filled with bulk material or a flexible receptacle filled with bulk material,
providing a connection body connected gas-tight with the base container, which
- is connected with a supplying and/or emptying facility and/or comprises a filling connection for introducing the bulk material, connecting the base container and the connection body gas tight in the sealing section and/or connecting a mating connection of the supplying and/or emptying facility to the filling connection, emptying the base container by means of the supplying and/or emptying facility, and separating the connection body from the base container or separating the mating connection from the filling connection after the base container of the flexible receptacle has been emptied.

By utilizing the method according to this development, the base container filled with the bulk material or the flexible receptacle filled with bulk material can be emptied in simple manner. Based on the fact that a gas-tight connection between base container and connection body can be provided, bulk material according to the OEB 4 standard under which concentrations up to 10 $\mu g/m^3$ are allowed can be processed.

According to a further developed implementation, the method comprises the following steps:

providing a base container filled with bulk material or a flexible receptacle filled with the bulk material, providing a connection body connected gas-tight with the base receptacle which is connected with a supplying and/or emptying facility and/or comprises a filling connection for the introduction of the bulk material, providing a flexible first envelope and a flexible second envelope for guiding the bulk material, providing a base container and a connection body which is connected with a supplying and/or emptying facility or comprises a filling connection for the introduction of the bulk material, connecting the first envelope and the second envelope with the development of a cleared opening by means of a docking lock, connecting the base container and the connection body gas-tight in the sealing section such that the sealing section is encompassed by the cleared opening and/or connecting a mating connection of the supplying and/or emptying facility to the filling connection such that the filling connection is encompassed by the cleared opening, emptying the base container or the flexible receptacle, separating the connection body from the base container or separating the mating connection from the filling connection after the base container or the flexible receptacle has been emptied and separating the first envelope from the second envelope with the formation of a closed opening.

This development of the method permits the processing of bulk material which must be treated according to the OEB 6 standard (maximum concentration 200 $ng/m^3$).

In a further implementation, the method comprises the following steps:

providing the supplying and/or emptying facility which comprises a flexible tube which is connectable gas-tight either with the connection body and/or with the base container in the sealing section or comprises a mating connection that is connectable with the filling connection of the connection body, connecting the base container or the connection body with the flexible tube gas-tight in the sealing section such that the sealing section is encompassed by the cleared opening and/or connecting the mating connection to the filling connection such that the filling connection is encompassed by the cleared opening, wherein the base container during the gas-tight connecting or during the connection of the mating connection to the filling connection is in a first position, in which the bulk material remains in the base container, and swivelling the base container into a second position in which the bulk material falls from the base container and is removed through the tube.

In this implementation the emptying can be implemented especially effectively since the force of gravity is also drawn on to empty the base container or the flexible receptacle. The quantity of unused bulk material that remains in the base container or in the flexible receptacle is minimized.

In a further implementation, the method comprises the step of disposing of at least the emptied base container by incinerating it.

In particular the disposal by incineration renders expensive cleaning superfluous. It is herein useful to fabricate the several components of the device of a readily burnable material such as synthetic material, in particular polyethylene. The entire device is consequently oriented toward "single use".

One implementation relates to the use of a device as in one of the precedingly discussed embodiments for storing and transporting pharmaceutical bulk material. The technical effects and advantages that can be obtained with the proposed utilization correspond to those that have been elaborated for the present device. In summary, it should be pointed out that toxic bulk material can also be handled in a simple and safe manner.

BRIEF DESCRIPTION OF DRAWINGS

In the following, exemplary embodiments will be discussed in greater detail with reference to the attached drawing. Therein depict FIG. 1A to 1H perspective representations of several embodiments of a device, all of which comprise a base container, FIG. 2A base containers stacked one above the other, FIG. 2B base containers disposed on a pallet, FIG. 3A to 3H several steps of a first method for emptying a flexible receptacle filled with bulk material, FIG. 4A to 4D several steps of a second method for emptying a flexible receptacle filled with bulk material, FIG. 5A to 5G several steps of a method for connecting a base container with a processing chamber, FIG. 6A to 6D several steps of a second method for emptying a base container filled with bulk material, FIG. 7A a perspective exploded representation of a base container placed into an enclosure facility, FIG. 7B a sectional representation through a base container placed into an enclosure facility, FIG. 7C a number of enclosure facilities with base containers placed therein disposed on a pallet, FIG. 8A to 8I several steps of a third method for emptying a base container filled with bulk material, FIGS. 9A and 9B several feasibilities of taking samples from base containers filled with bulk material, and FIG. 10A to 10C several representations of an adapter body connected with a base container, into which a flexible receptacle has been placed.

DETAILED DESCRIPTION

Figure 1A:
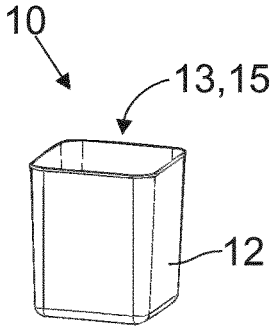

In FIG. 1A a base container 12 of a device 10 is shown in conjunction with a perspective representation. The base container 12 is substantially orthogonal in form and encompasses a hollow volume 13. In the hollow volume 13 can be received a bulk material not shown here.

The hollow volume 13 is accessible via an access opening 15. Onto the base container 12 a connection body 14 can be connected which, for example in FIG. 1B, is implemented as a cover 18.

When connected, the base container 12 and the connection body 14 form a sealing section 16 (FIG. 1D) in which the base container 12 and the connection body 14 are connected gas-tight with one another. In FIG. 1C the connection body 14 is shaped in the form of a pyramid and comprises a filling connection 20 to which a mating connection 22 can be connected (see for example FIG. 3F). In FIG. 1D the connection body 14 according to FIG. 1C is secured on the base container 12 forming the already cited sealing section 16. In FIG. 1E an inverting frame 24 is secured with the base container 12, with which it is feasible to swivel the base container 12 and the connection body 14 connected to the base container 12 about a rotational axis D which conventionally extends horizontally. The inverting serves in particular for mixing the bulk material disposed in the base container 12 and for emptying the base container 12 filled with bulk material.

Figure 1B:
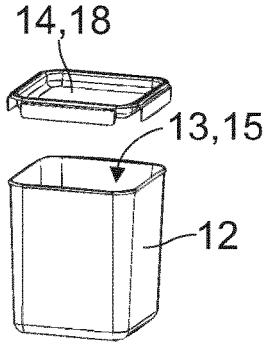
Figure 1C:
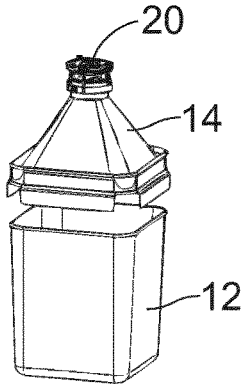
Figure 1D:
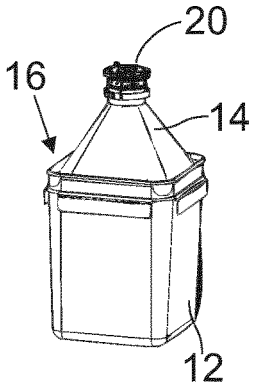
Figure 1E:
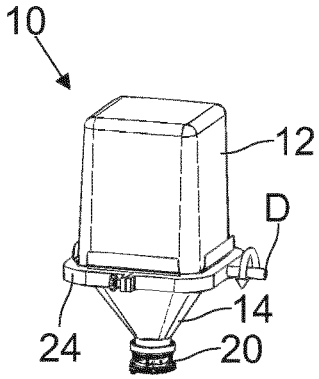
Figure 1F:
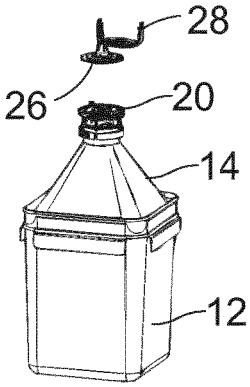
Figure 1G:
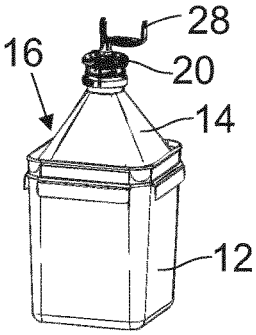
Figure 1H:
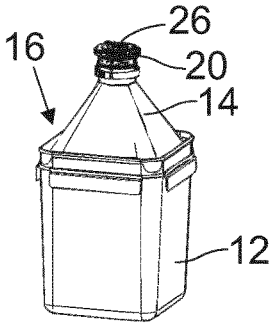

As is discernible in FIGS. 1F to 1H, the filling connection 20 can be sealed with a protective lid 26. The protective lid 26 can be grasped with a grip 28, placed onto the filling connection 20 and subsequently be connected with the filling connection 20. After the protective lid 26 is secured on the filling connection 20, the grip 28 can be removed as is evident in FIG. 1H. The protective lid 26 serves for the protection of the filling connection 20 and counteracts the uncontrolled escape of bulk material through the filling connection 20. The protective lid 26 can, moreover, provide an indication of whether or not the base container 12 is filled with bulk material. For this purpose, protective lids 26 in different colors can be utilized.

Figure 2A:
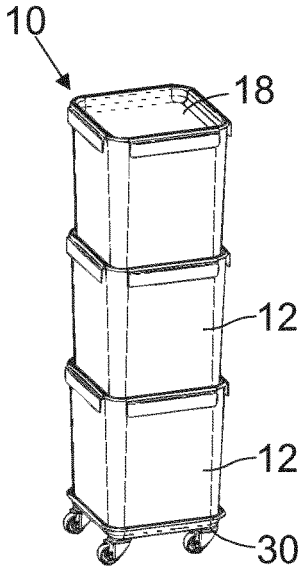

In FIG. 2A an embodiment of the device 10 is depicted which comprises a wheeled transporter 30 on which a total of three base containers 12 are stacked which are each closed with a cover 18 shown in FIG. 1B.

Figure 2B:
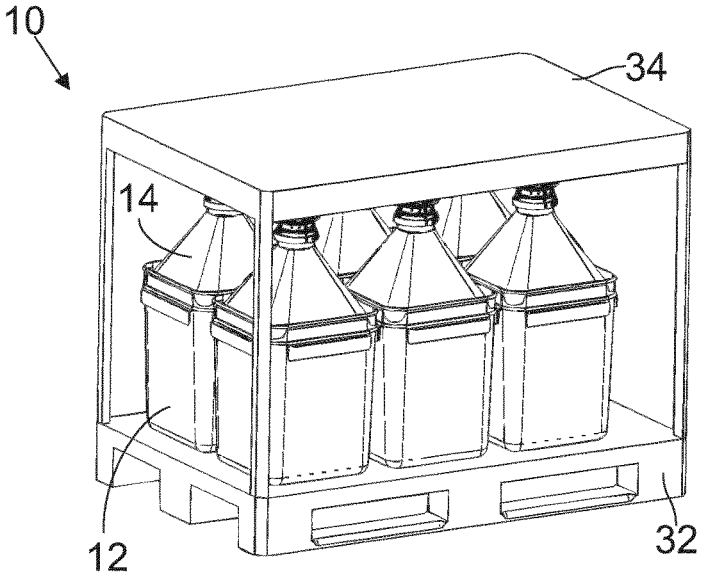

In FIG. 2B overall six base containers 12 disposed on a pallet 32 are depicted that are closed with the pyramid-shaped connection body 14 which is shown in FIGS. 1C to 1H. The pallet 32 comprises in this case a wall 34 that protects the base containers 12 against damage.

In FIGS. 3A to 3H are depicted several steps of a first method for emptying a flexible receptacle 36 filled with bulk material. As is evident in FIGS. 3A and 3B, the flexible receptacle 36 can be placed into the base container 12. The flexible container 36 is closed with a first closure facility 42 that forms a part of a docking lock 40. The second part of the docking lock 40 is formed by a second closure facility 44 shown in FIGS. 3C and 3D. The second closure facility 44 is disposed on a flexible first envelope 45 which is connected with an adapter body 46 disposed between the base container 12 and the connection body 14 and can be connected gas-tight therewith forming in each instance a sealing section 16. The adapter body 46 comprises at a first end a first passage opening 47 and at a second end a second passage opening 49.

Figure 3A:
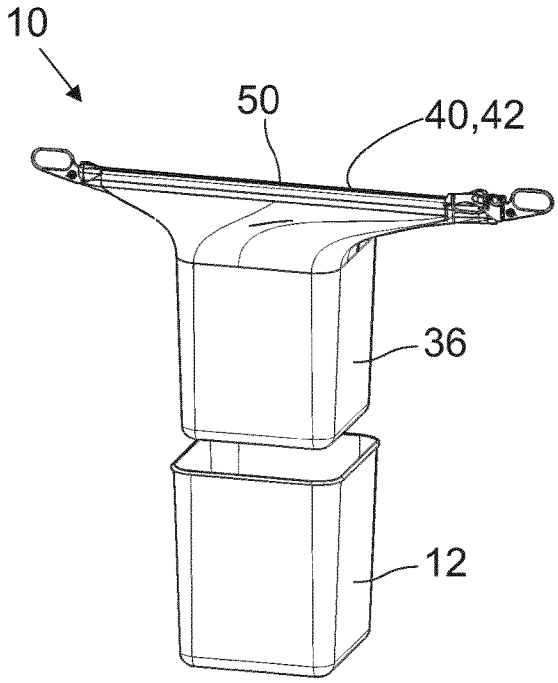
Figure 3B:
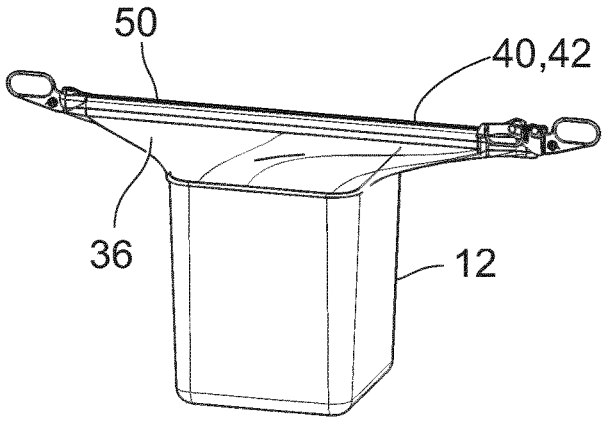
Figure 3C:
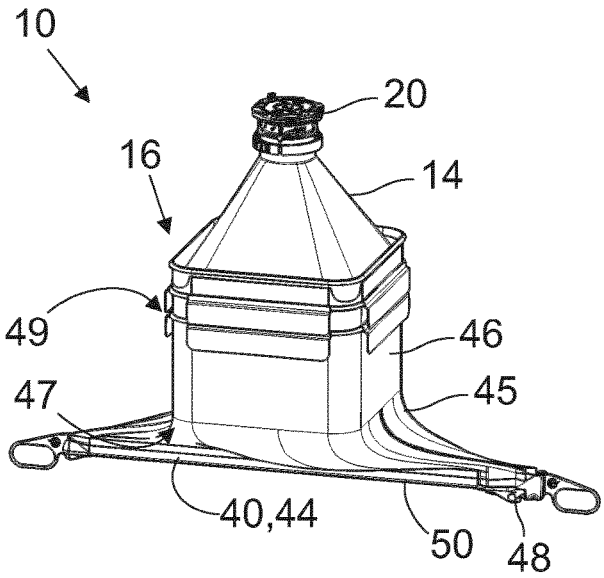
Figure 3D:
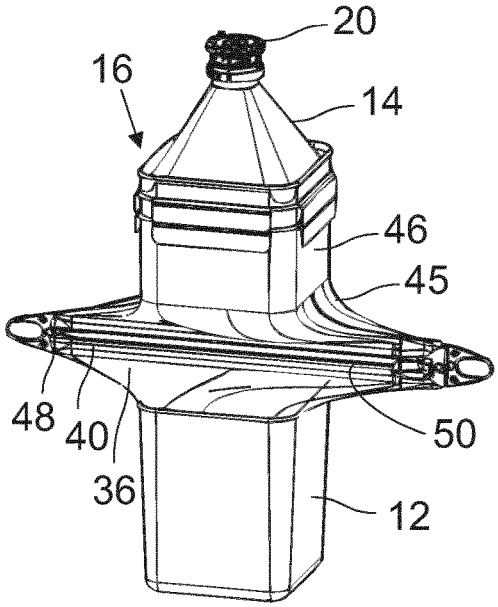
Figure 3E:
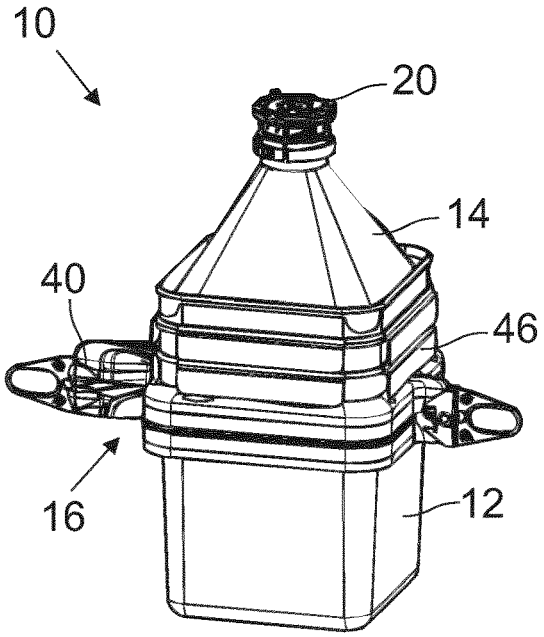

The first closure facility 42 and the second closure facility 44 are connected with one another such that two parts of a zipper 48 mesh with one another, which subsequently, referred to the representation selected in FIGS. 3A to 3H, is moved from right to left (cf. FIGS. 3C and 3D). The movement of the zipper 48 effectuates, on the one hand, that the first closure facility 42 and the second closure facility 44 are connected with one another and, on the other hand, that an opening 50 is cleared through which the adapter body 46 can be guided and be connected gas-tight with the base container 12, as is the case in FIG. 3E. The sealing section 16, formed by the base container 12 and by the adapter body 46, is consequently encompassed by the flexible receptacle 36 and by the flexible first envelope 45. In the event a portion of the bulk material escapes across the sealing section 16, it is captured by the flexible first envelope 45 and the flexible receptacle 36 such that this bulk material cannot escape into the environment unchecked.

Figure 3F:
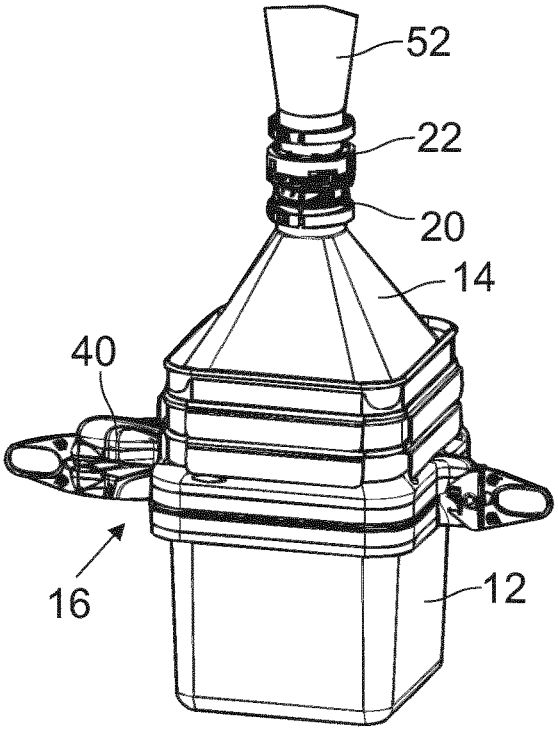

In FIG. 3F the already cited mating connection 22 is connected to the filling connection 20 of the connection body 14. The mating connection 22 is part of a supplying and/or emptying facility 52 across which the bulk material is introduced into the base container 12 and can be removed therefrom. The filling connection 20 and the mating connection 22 can together form a double flap that can be opened when the filling connection 20 and the mating connection 22 are connected with one another as intended.

In the configuration shown in FIG. 3F the base container 12 can be filled with the bulk material after the filling connection 20 and the mating connection 22 have been opened with a common movement. In the manner described above, the escape of bulk material through the sealing section 16 is prevented by the flexible first envelope 45 and the flexible receptacle 36.

Figure 3G:
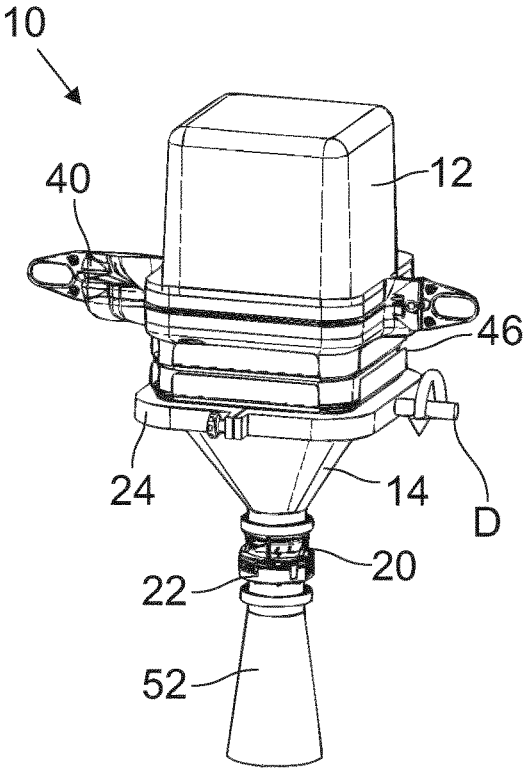
Figure 3H:
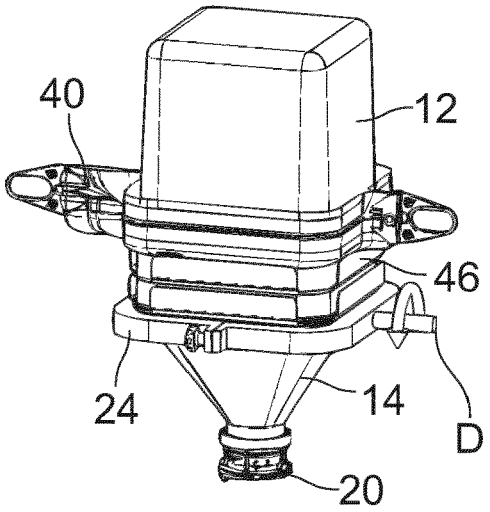

In FIGS. 3G and 3H a first method for emptying the flexible receptacle 36 is depicted. In FIG. 3G is discernible that the inverting frame 24, also already mentioned above, is connected to the adapter body 46 and to the connection body 14. The base container 12 is swivelled by 180° about a substantially horizontally extending rotational axis D such that the bulk material can fall out of the base container 12 and reach the supplying and/or emptying facility 52. When the base container 12 is completely empty, the filling connection 20 and the mating connection 22 are closed and separated from one another as is shown in FIG. 3H. The empty base container 12 can subsequently be disposed of (not shown) together with the adapter body 46 and the connection body 14. It should be noted that the docking lock 40 in the connected state can be jointly disposed of.

Figure 4A:
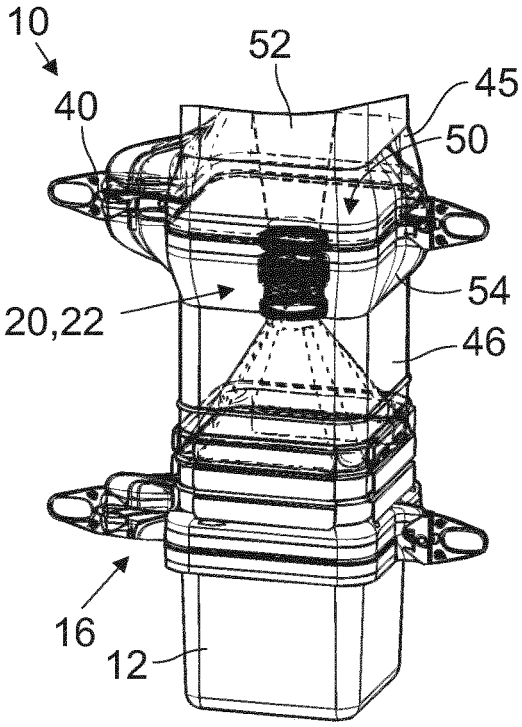
Figure 4B:
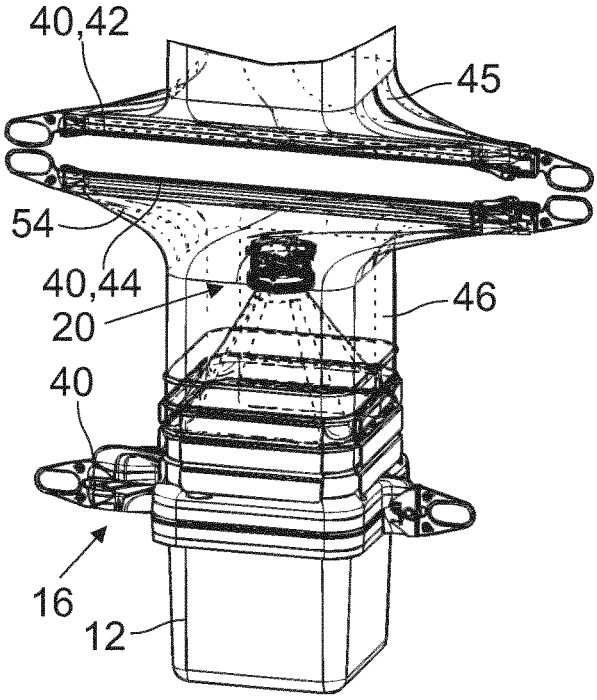
Figure 4C:
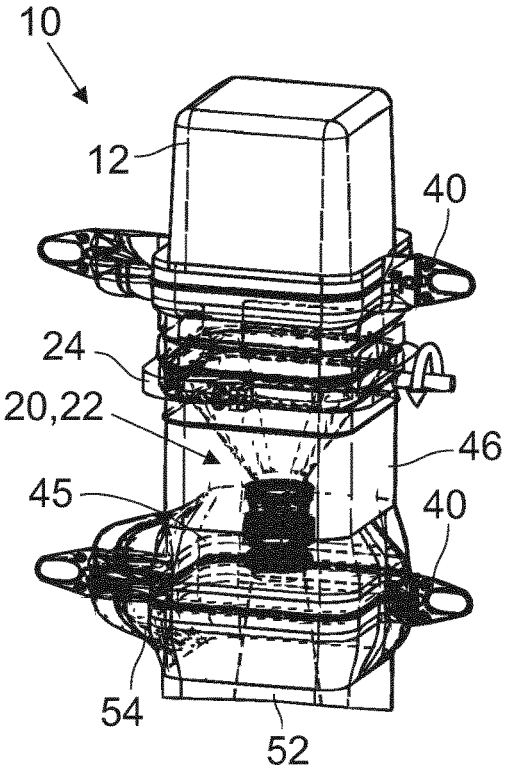
Figure 4D:
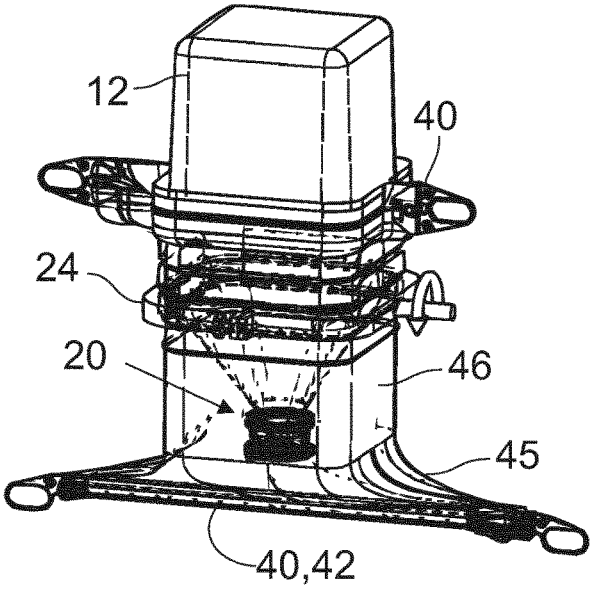

In FIGS. 4A and 4B two steps of a second method for filling and in FIGS. 4C and 4D two steps two steps of a second method for emptying the base container 12 are depicted, wherein the principal steps correspond to those that were depicted in FIGS. 3A to 3H. The significant difference comprises therein that on the adapter body 46 additionally a flexible second envelope 54 and on the supplying and/or emptying facility 52 a further first flexible envelope 45 are disposed. The flexible second envelope 54 and the flexible further first envelope 45 can again be connected with the docking lock 40 with one another in the manner described above. As already cited in connection with the embodiment example according to FIGS. 3A to 3H, the sealing section 16, formed by base container 12 and adapter body 46, is encompassed by the flexible receptacle 36 and the flexible first envelope 45. In this embodiment example the filling connection 20 and the mating connection 22 are, furthermore, encompassed by the flexible second envelope 54 and the flexible further first envelope 45. In contrast [sic] to the embodiment example according to FIGS. 3A to 3H, in this embodiment example the unchecked escape of bulk material through the filling connection 20 and the mating connection 22 into the environment is also prevented.

In FIGS. 4A and 4B is discernible that the filling connection 20 and the mating connection 22 are closed and separated from one another after completion of the filling process before the docking lock is opened and consequently the first envelope 45 and the second envelope 54 are closed. In FIGS. 4C and 4D is depicted that the base container 12 swivelled by 180° is emptied first. The filling connection 20 and the mating connection 22 are subsequently closed and separated from one another such that the docking lock 40, formed by the flexible further first envelope 45 and the second envelope 54, can be opened whereby the further first envelope 45 and the second envelope 54 are closed.

While the method shown in FIGS. 3A to 3H is suitable for bulk material that can be handled according to the OEB 4 standard, the method shown in FIGS. 4A to 4D lends itself for bulk material that must be handled according to the OEB 6 Standard.

Figure 5A:
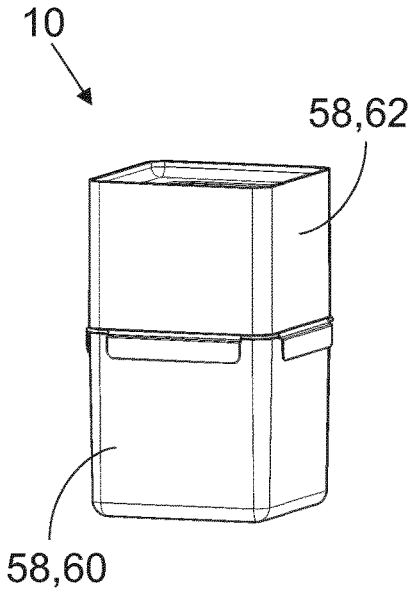
Figure 5B:
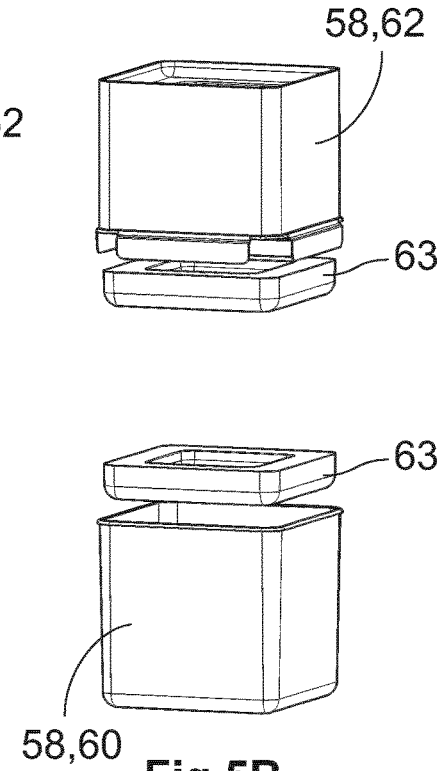
Figure 5C:
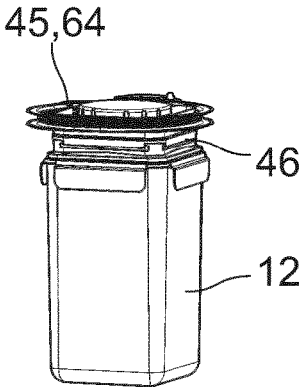
Figure 5D:
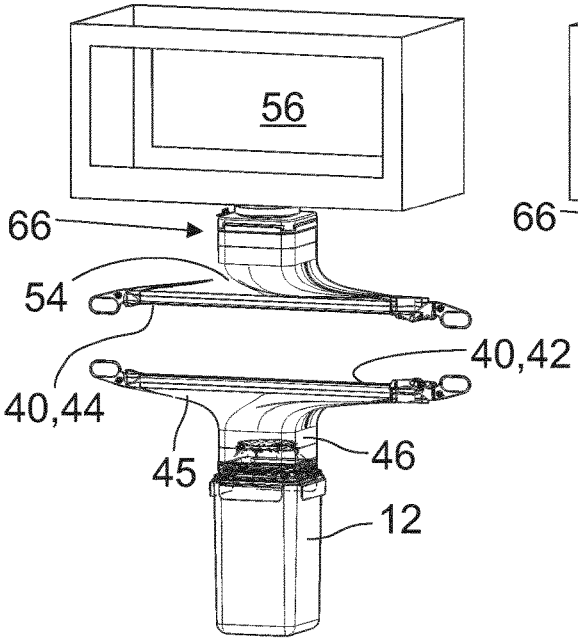

In FIGS. 5A to 5G several steps of a method for connecting a base container 12 with a processing chamber 56 are depicted. As can be seen in FIG. 5A, the device 10 comprises an enclosure facility 58 which is comprised of an enclosure container 60 and an enclosure upper shell 62 connectible gas-tight with the enclosure container 60. The device 10 furthermore comprises two clamping elements 63 which can be comprised, for example, of expanded polystyrene and be structured identically. The two clamping elements 63 can be introduced into the enclosure container 60 and the enclosure upper shell 62. As can be seen in FIG. 5C, the base container 12 can also be placed into the enclosure facility 58 such that the base container 12 is completely encompassed by the enclosure facility 58 and be fixed in the enclosure facility 58 using the two clamping elements 63.

To connect the base container 12 with the processing chamber 56, which is depicted in FIGS. 5D to 5G, first, the base container 12 is removed from the enclosure facility 58. The base container 12 depicted in FIG. 5C is connected with the already cited adapter body 46 to which a flexible first envelope 45 in the folded and closed state is secured by means of a carrier body 64. The adapter body 46 itself is not directly closable with a cover 18 or the like that can be connected gas-tight with the adapter body 46. To this extent the adapter body 46 is structured differently in this regard than the connection body 14 shown in FIGS. 1C to 1H. The adapter body 46, and consequently also the base container 12, are therefore closed exclusively with the flexible first envelope 45.

Figure 5E:
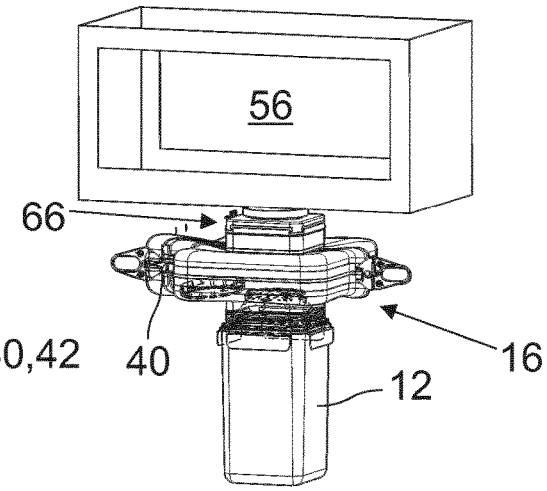
Figure 5F:
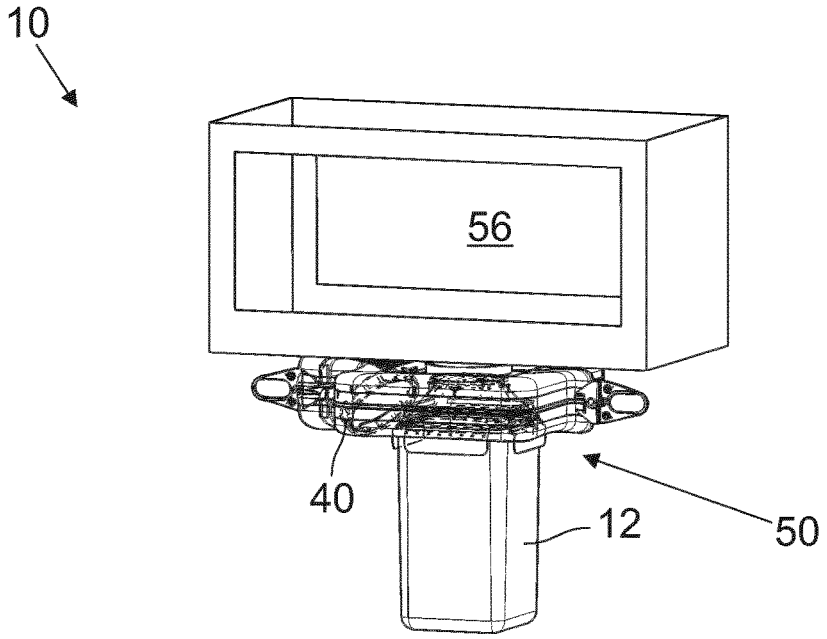
Figure 5G:
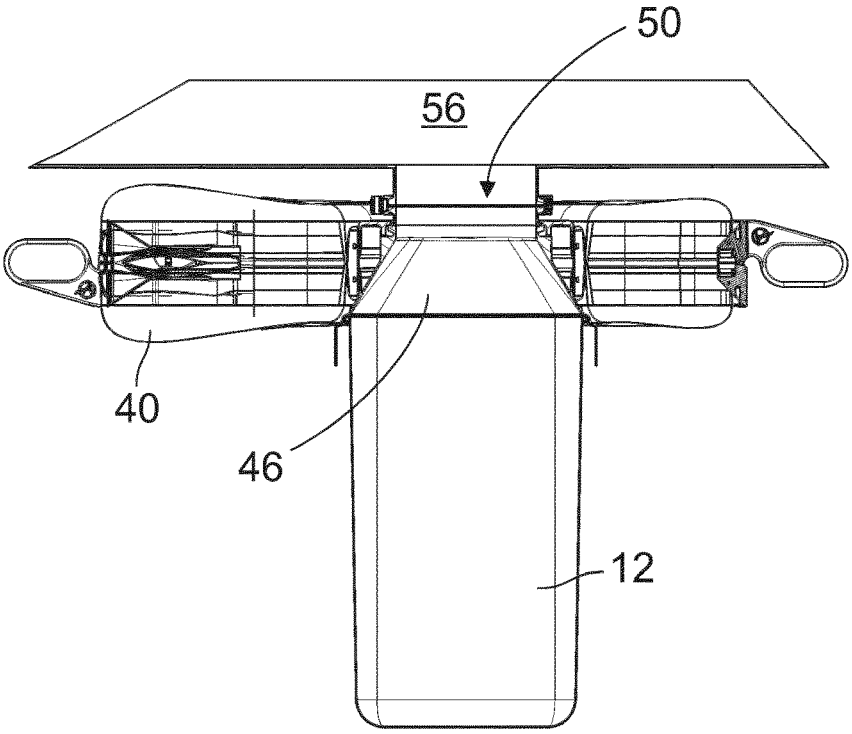

Correspondingly, the processing chamber 56 comprises a processing connection 66 that can be connected gas-tight with the adapter body 46 forming a sealing section 16 (FIG. 5E). The processing connection 66 is connected with a flexible second envelope 54 which, as is evident in FIG. 5B, can be connected with the flexible first envelope 45 forming a cleared opening 50 through which the processing connection 66 can be guided in order to be connected gas-tight with the adapter body 46 (cf. FIGS. 5E to 5F). The bulk material can subsequently be conducted from the processing chamber 56 into the base container 12 and conversely.

In FIGS. 6A to 6D several steps of a second method for emptying a base container 12 filled with bulk material are shown in conjunction with perspective representations. The base container 12 utilized in this method corresponds herein to that depicted in FIGS. 5C to 5G.

The supplying and/or emptying facility 52 comprises in this case a flexible tube 68. Like the processing chamber 56 depicted in FIGS. 5D to 5G, the tube 68 comprises a processing connection 66 which can be connected gas-tight with the adapter body 46 forming a sealing section 16. A flexible second envelope 54 is connected with the processing connection 66 which, as is evident in FIG. 6B, can be connected with the flexible first envelope 45 forming a cleared opening 50 through which the processing connection 66 can be guided to be connected gas-tight with the adapter body 46 (see FIG. 6C). In the state shown in FIG. 6C the base container 12 can be filled with bulk material for which purpose the flexible tube 68 can cooperate with a not depicted conveyance facility which, for example by applying compressed air, conveys the bulk material through the flexible tube 68 to the base container 12. The base container 12 is herein oriented such that its bottom points downwardly and its access opening 15 points upwardly.

Figure 6A:
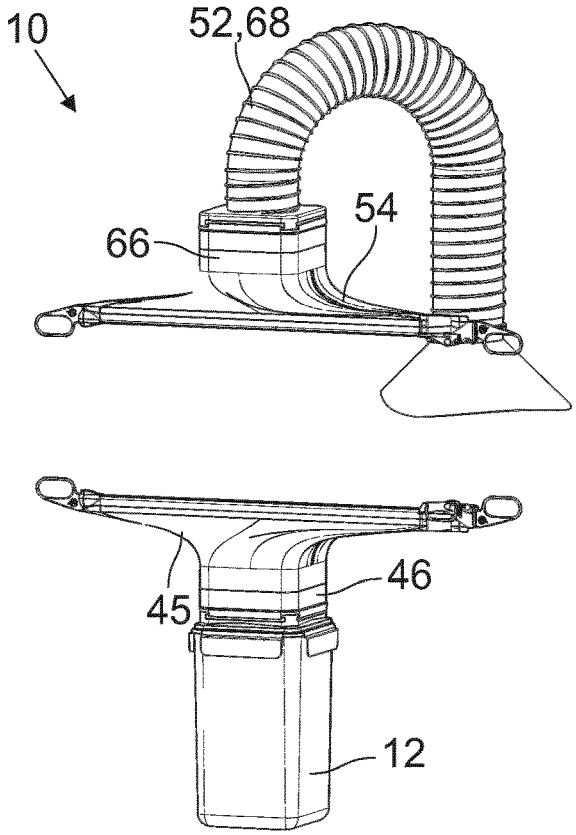
Figure 6B:
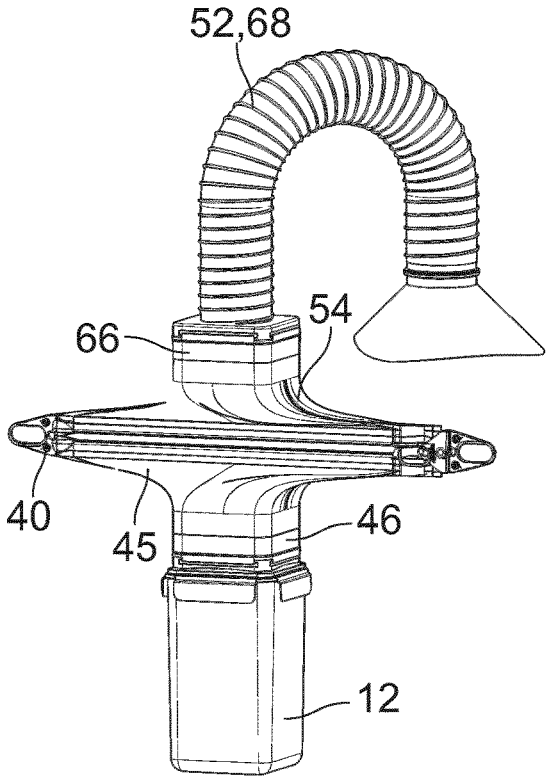
Figure 6C:
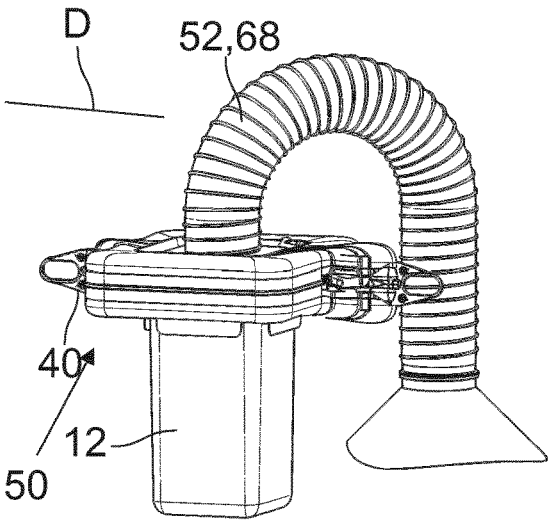
Figure 6D:
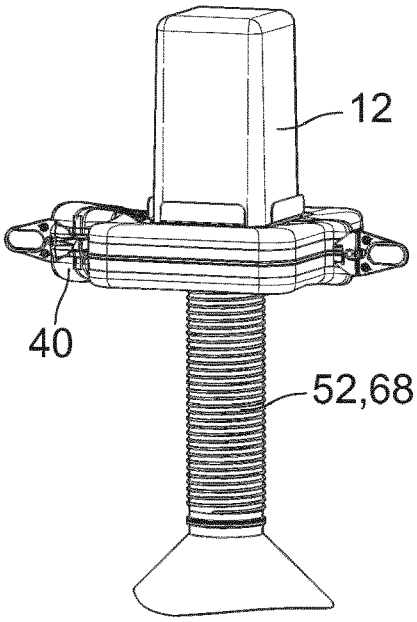

When the base container 12 is to be emptied, the base container 12 can be swivelled with a not shown moving facility, in particular using the inverting frame 24 shown inter alia in FIGS. 3G to 3H, in order to be swivelled about a horizontally extending rotational axis D such that the bottom points upwardly and the opening 15 points downwardly, as can be seen in FIG. 6D. The bulk material falls under the force of gravity from the base container 12 into the flexible tube 68 where it can be transported further.

Figure 7A:
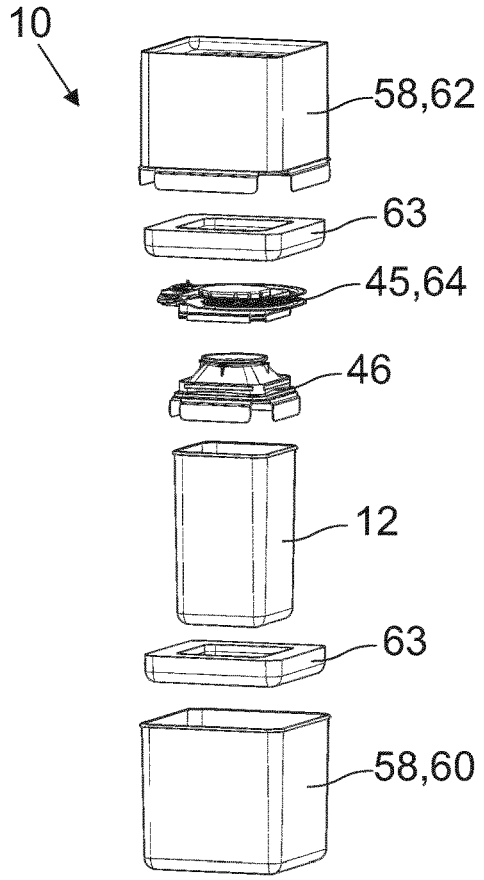
Figure 7B:
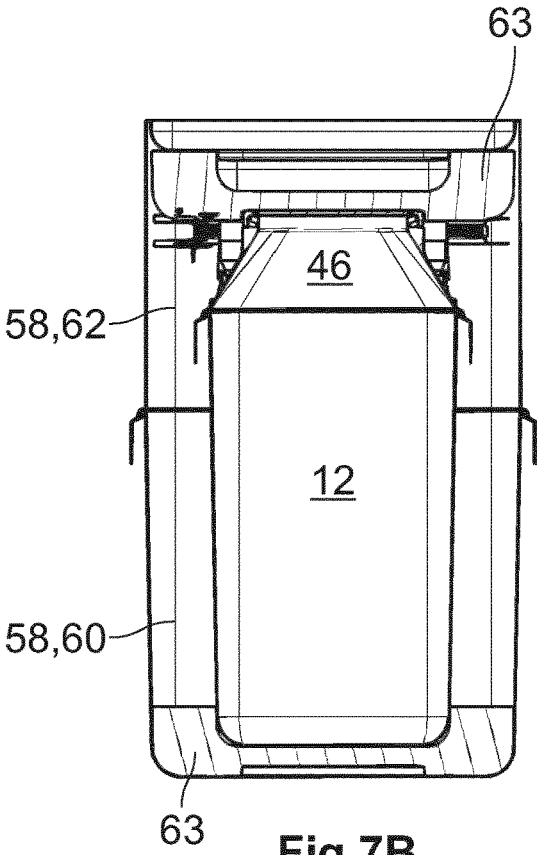
Figure 7C:
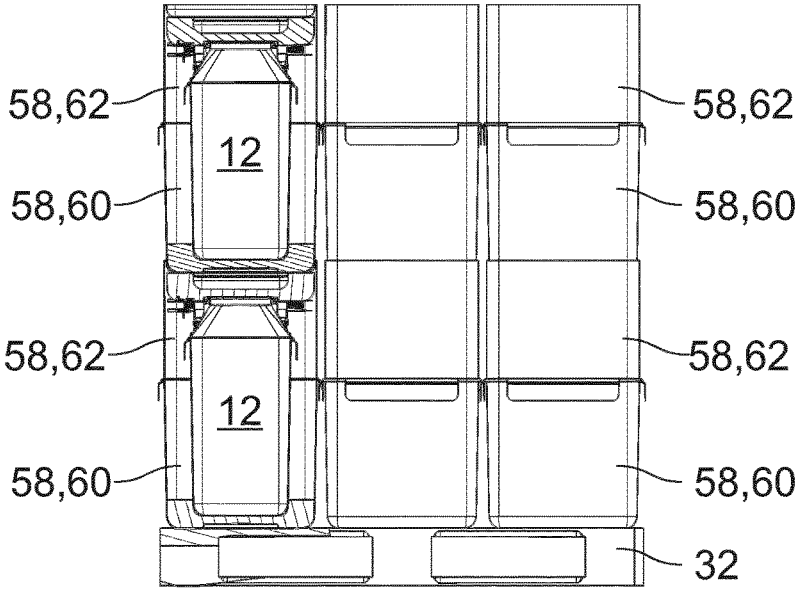

In FIGS. 7A and 7B the enclosure facility 58, shown in FIGS. 5A and 5B, is shown once again into which the base container 12, the adapter body 46 and the folded first envelope 45 have been placed. While in FIG. 7A an exploded representation is depicted, FIG. 7B is a sectional representation through the enclosure facility 58. In FIG. 7C several enclosure facilities 58 with base container 12, adapter body 46 and folded first envelope 45 are disposed on a pallet 32, wherein is discernible in FIG. 7C that two enclosure facilities 58 are stacked one above the other. The pallet 32 can be utilized in particular for the base container 12 filled with bulk material to be delivered or to transport away the emptied base container 12 for disposal.

In FIGS. 8A to 8I several steps of a third method for emptying a base container 12 filled with bulk material are depicted. In this case the base container 12 filled with bulk material is connected to the already described adapter body 46 that is shown in FIGS. 6A to 6D. The adapter body 46 encompasses the connection body 12 and is connected gas-tight with a connection body 14 which, in turn, is connected with a further first envelope 45.

The base container 12 is connected with a first envelope 45 and the adapter body 46 is connected with a second envelope 54. The sealing section 16, formed by base container 12 and adapter body 46, consequently, is encompassed by the first envelope 45 and the second envelope 54 connected by means of the docking lock 40. The further first envelope 45 can be connected with a further second envelope 54 utilizing a second docking lock 40, as is also shown in FIGS. 4A to 4D. The further second envelope 54 in this case is connected with a reactor 70 in which the bulk material can be further processed. The reactor 70 comprises for this purpose a securement plate that can be connected gas-tight with the adapter body 46.

Figure 8A:
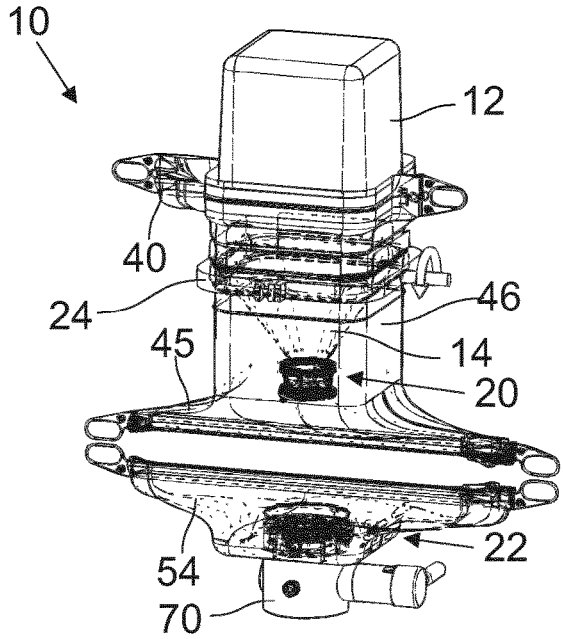
Figure 8B:
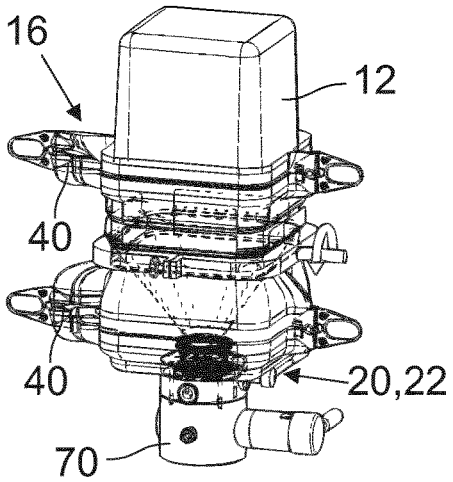
Figure 8C:
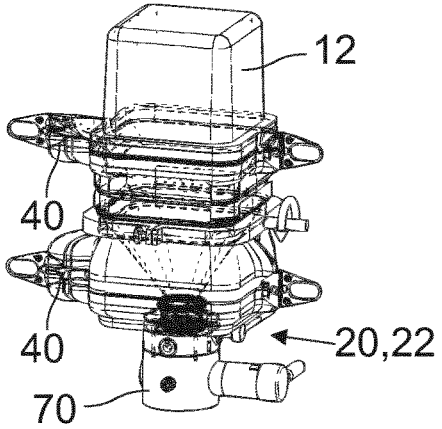
Figure 8D:
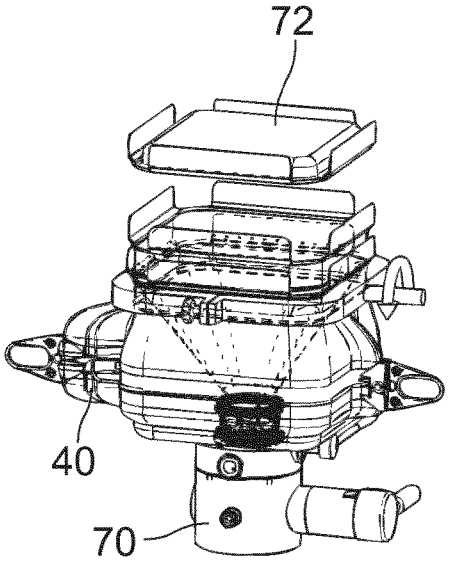
Figure 8E:
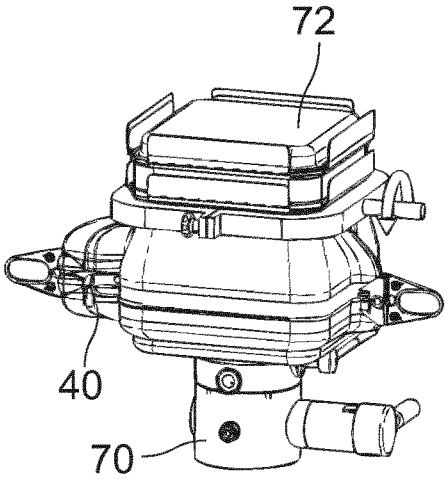
Figure 8F:
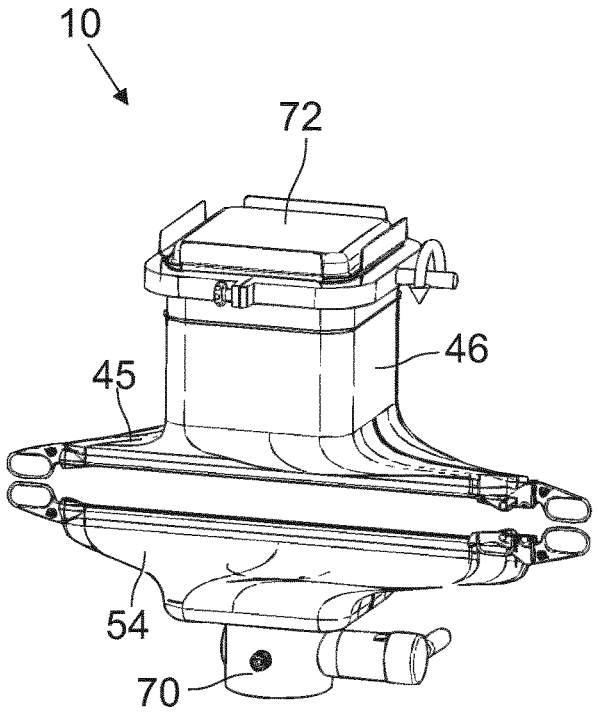
Figure 8G:
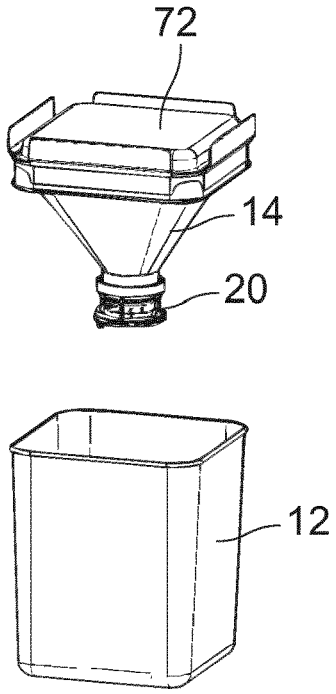
Figure 8H:
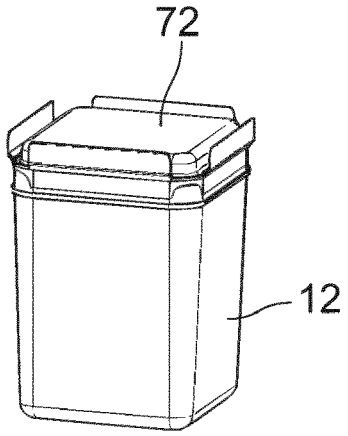
Figure 8I:
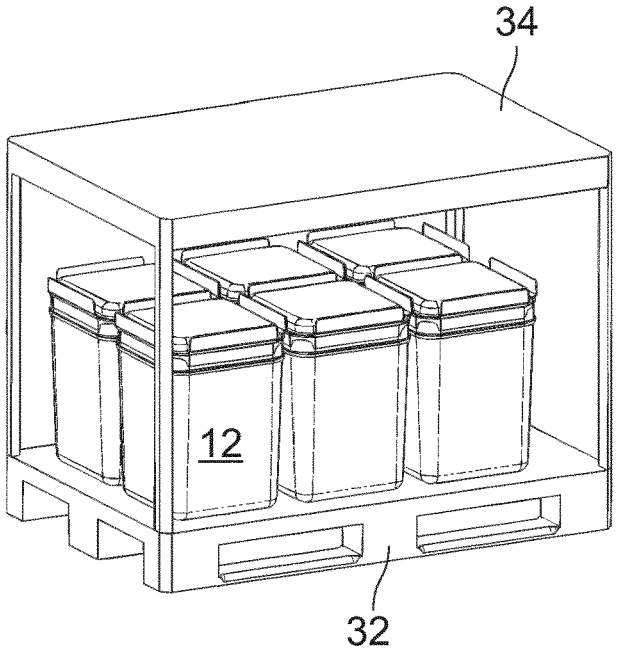

The reactor 70 comprises the mating connection 22 which can be connected with the filling connection 20 of the connection body 14 in the manner of a double flap. The mating connection 22 is herein oriented such that it points upwardly such that the base container 12 and the connection body 14 must be swivelled by means of the inverting frame 24 such that the filling connection 20 points downwardly. In FIG. 8C the filling connection 20 is connected with the mating connection 22 and is opened such that the bulk material can reach from the base container 12 into the reactor 70. After the base container 12 has been completely emptied, the first docking lock 40 is opened such that the base container 12 can be separated and removed from the connection body 14. Instead of base container 12, now the connection body 14 is closed by means of a closure cover 72 as is shown in FIGS. 8D and 8E. The closure cover 72 can be structurally identically to the cover 18 shown in FIG. 1B. To this extent several and differently developed connection bodies 14 are utilized. The further first envelope 45 of adapter body 46 is now separated from the further second envelope 54 of the reactor as is shown in FIG. 8F. For its disposal, the connection body 14 can be placed into the base container 12 as is shown in FIGS. 8G and 8H whereby space can be saved. The base container 12 with the connection body 14 placed therein is, as is in shown in FIG. 8I, put onto a pallet 32 with which a multiplicity of base containers 12 can be transported away for their disposal.

Figure 9A:
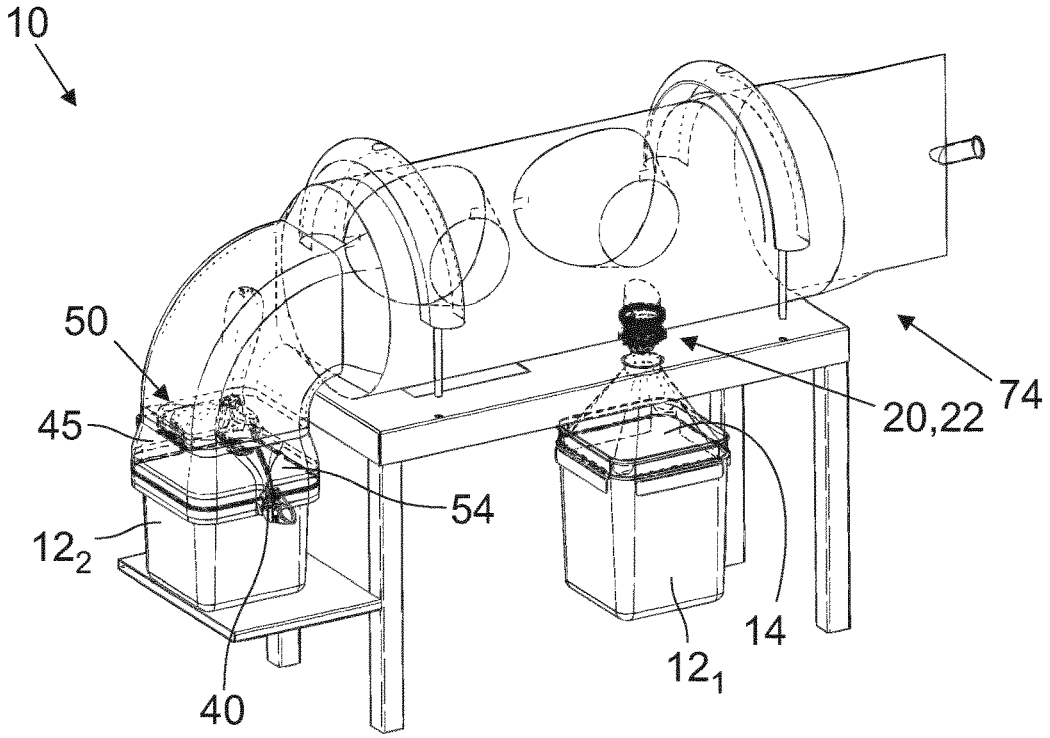
Figure 9B:
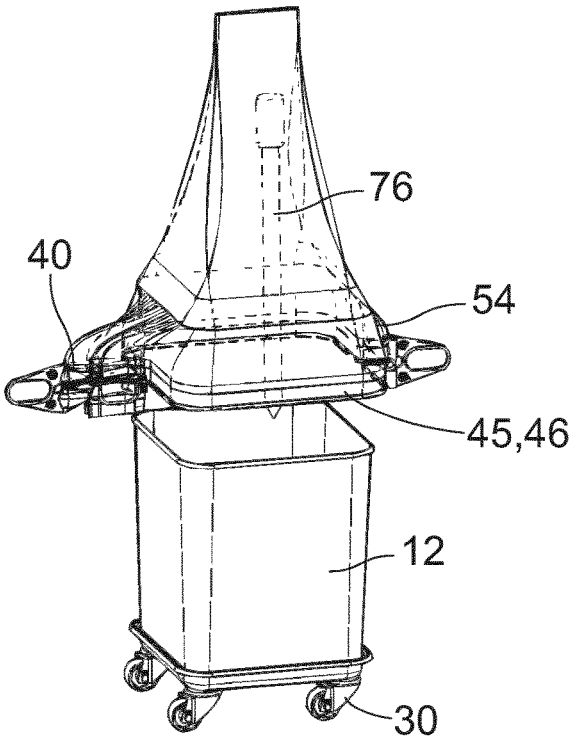

In FIGS. 9A and 9B are shown several feasibilities of taking samples from the base container 12 filled with bulk material. In FIG. 9A a first base container $\mathbf{12}_1$ with a connection body 14 connected thereon is connected with an insulator 74. The connection body 14 comprises the already described filling connection 20 which is connected with a mating connection 22 disposed on the insulator and which can be opened in the manner of a double flap. Furthermore, a second base container $\mathbf{12}_2$ is connected to insulator 74 wherein, however, the second base container $\mathbf{12}_2$ is connected with a flexible first envelope 45. On the insulator 74 a flexible second envelope 54 is disposed which, utilizing the docking lock 40, also discussed several times in the preceding pages, can be connected with one another. An operator, not depicted here, can engage by means of a protective device into the interior volume encompassed by insulator 74. The operator can, furthermore, reach through the cleared opening 50 of the docking lock 40 into the second base container $\mathbf{12}_2$ in order to take from it a sample of the bulk material and to transfer it across the opened filling connection 20 and the opened mating connection 22 to the first base container $\mathbf{12}_1$.

In FIG. 9B a further feasibility of taking a sample is depicted. Onto the base container 12 an adapter body 46 can be placed such that it is gas-tight, which is provided with a first envelope 45. By using the docking lock 40 a second envelope 54 can be connected with the first envelope 45 and a cleared opening 50 between the base container 12 and the adapter body 46 can be provided. In the volume encompassed by the second envelope 54 a sample-taking device 76 is disposed which can be grasped from the outside and be introduced into the base container 12, wherein the sample-taking device 76 passes through the cleared opening 50. As soon as the desired quantity of bulk material has been removed from the base container 12, the sample-taking device 76 is returned again into the volume encompassed by the second envelope 54 and the pressure closure [sic] is closed. The removed sample is consequently disposed within the second envelope 54 and can be further transported for further analysis and be processed.

Figure 10A:
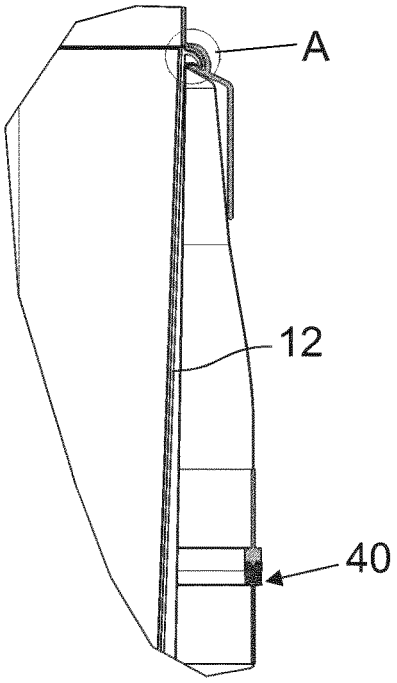
Figure 10B:
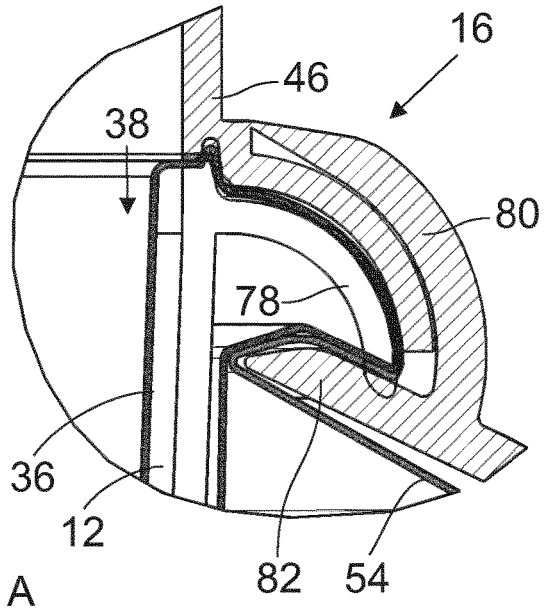
Figure 10C:
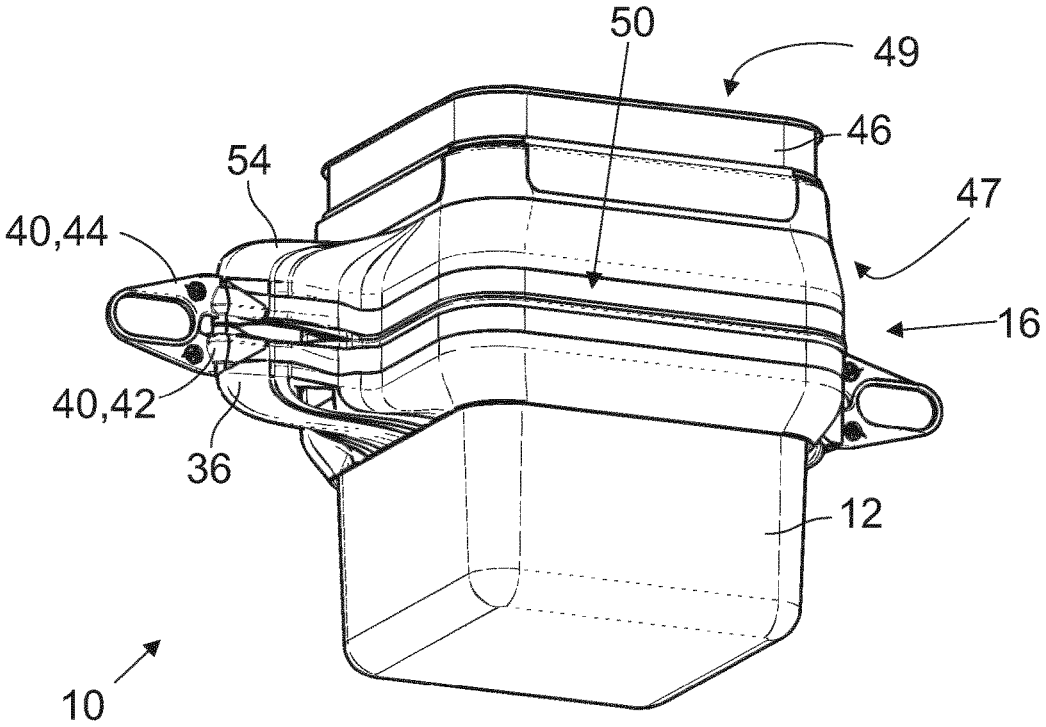

In FIGS. 10A to 10C several representations of an adapter body 46 are shown which is connected with a base container 12 in which a flexible receptacle 36 has been placed. In the same manner, a connection body 14 can also be connected with the base container 12. On the adapter body 46 is secured a flexible second envelope 54.

FIG. 10B represents an enlargement of the segment A marked in FIG. 10A. In FIGS. 10A and 10B is discernible that, when connected, the base container 12 and the adapter body 46 form a sealing section 16 into which the flexible receptacle 36 and the flexible second envelope 54 can be clamped and with which the base container 12 and the adapter body 46 are connectable gas-tight with one another. The sealing section 16 comprises a first sealing contour 78, formed by the base container 12, and a second sealing contour 80, formed by the adapter body 46, between which the flexible receptacle 36 and the flexible second envelope 54 are placed in the connected state. In cross section the first sealing contour 20 [sic: 78] describes approximately a quarter circle, and is thus substantially structured in the form of a circular ring sector. The second sealing contour 80 comprises a projection 82 which, in the connected state, engages into the volume encompassed by the first sealing contour 78, whereby a form closure is generated.

With reference to FIG. 10C the adapter body 46 is disposed aligned over the base container 12, the two closure facilities 42, 44 of the docking lock 40 are connected with one another and the docking lock 40 is opened. Consequently, a cleared opening 50 and consequently a passage encompassed by the docking lock 40 is created such that the adapter body 46 and the base container 12 can be connected with one another forming the sealing section 16. The bulk material can now be moved into the base container 12 or be removed from the base container 12. Instead of the adapter body 46, the connection body 14 can analogously be connected with the base container 12.

As is evident based on the above description, the device 10 represents a type of construction kit which comprises entirely different components. A user can select those components that are required for handling the bulk material utilized by him. He can, in particular, be thereby taking into account the toxicity and the relevant OEB standards to be applied.

LIST OF REFERENCE SYMBOLS

10 Device
12 Base container
$\mathbf{12}_1$, $\mathbf{12}_2$ Base container
13 Hollow volume
14 Connection body
15 Access opening
16 Sealing section
18 Cover
20 Filling connection
22 Mating connection
24 Inverting frame
26 Protective lid
28 Grip
30 Wheeled transporter
32 Pallet
34 Wall
36 Flexible receptacle
40 Docking lock
42 First closure facilities
44 Second closure facilities
45 First envelope
46 Adapter body
47 First passage opening
48 Zipper

49 Second passage opening
50 Opening
54 Second envelope
52 Supplying and/or emptying facility
56 Processing chamber
58 Enclosure facility
60 Enclosure container
62 Enclosure upper shell
63 Clamping element
64 Carrier body
66 Processing connection
68 Hose
70 Reactor
72 Closure cover
74 Insulator
76 Sample-taking device
78 First sealing contour
80 Second sealing contour
82 Projection
D Rotational axis

The invention claimed is:

1. A device for storing and transporting bulk material, comprising:

a base container; and a connection body detachably connectable with the base container, wherein the base container and the connection body in a connected state form a sealing section with which the base container and the connection body are connected gas-tight with one another, wherein the sealing section comprises a first sealing contour formed by the base container and a second sealing contour formed by the connection body, which, in the connected state, are in gas-tight contact on one another, wherein the connection body comprises a filling connection, that can be closed gas-tight, for introducing and emptying of the bulk material, and an adapter body with a first passage opening and a second passage opening, wherein the adapter body in a region of the first passage opening comprises a first sealing section comprising a first sealing contour and in a region of the second passage opening comprises a second sealing section comprising a second sealing contour such that the adapter body is connected gas-tight with the base container at the first passage opening and the connection body at the second passage opening, wherein the adapter body in a connected state is arranged between the base container and the connection body, a plurality of enclosure facilities, wherein each enclosure facility encompasses an interior volume into which the base container is placeable in between two clamping elements, wherein one clamping element covers a top of the base container and the other clamping element covers a bottom of the base container, and comprises an enclosure container and an enclosure upper shell that are gas-tight connectable with one another, the plurality of enclosure facilities arranged such that at least one enclosure facility is stacked on top of another enclosure facility without the base container of one enclosure facility being in contact with another base container of an adjacent enclosure facility.

2. The device as in claim 1, wherein the filling connection is closable by a protective lid.

3. The device as in claim 1, further comprising a wheeled transporter onto which one or several of base containers is placeable.

4. The device as in claim 1, further comprising a pallet onto which one or several of the base containers is placeable.

5. The device as in claim 1, further comprising an inverting frame, connectable with the base container, with which the base container can be swiveled about a rotational axis (D).

6. The device as in claim 1, further comprising a flexible receptacle, placeable into the base container, and wherein the flexible receptacle is gas-tight clampable into the sealing section.

7. The device as in claim 6, wherein the connection body is connected with the supplying and/or emptying facility with which the bulk material is: placeable into the flexible receptacle or removed from the flexible receptacle.

8. The device as in claim 1, wherein the flexible receptacle is clamped between the first sealing contour and the second sealing contour in the connected state.

9. The device as in claim 1, further comprising a flexible first envelope and a flexible second envelope for guiding the bulk material, wherein the flexible first envelope and the second flexible envelope are detachably connectable with one another by a docking lock with a clearable and closable opening.

10. The device as in claim 9, wherein a flexible receptacle is detachably connectable with the first envelope or the second envelope utilizing the docking lock.

11. The device as in claim 10, wherein the first envelope, the second envelope or the flexible receptacle with a cleared opening encompasses the sealing section of the connection body, the first sealing section of the adapter body or the second sealing section of the adapter body or the filling connection and/or a mating connection.

12. The device as in claim 1, further comprising an enclosure facility that encompasses an interior volume into which the base container is placeable.

13. The device as in claim 12, wherein the enclosure facility comprises an enclosure container and an enclosure upper shell that are gas-tight connectable with one another.

14. The device as in claim 13, wherein the base container, the connection body, the flexible receptacle, the adapter body, the enclosure container and/or the enclosure upper shell are fabricated of a synthetic material.

15. A device for storing and transporting bulk material, comprising:

a base container; and a connection body detachably connectable with the base container, wherein the base container and the connection body in a connected state form a sealing section with which the base container and the connection body are connected gas-tight with one another, wherein the sealing section comprises a first sealing contour formed by the base container and a second sealing contour formed by the connection body, which, in the connected state, are in gas-tight contact on one another, wherein the connection body comprises a filling connection, that can be closed gas-tight, for introducing and emptying of the bulk material, and an adapter body with a first passage opening and a second passage opening, wherein the adapter body in a region of the first passage opening comprises a first sealing section comprising a first sealing contour and in a region of the second passage opening comprises a second sealing section comprising a second sealing contour such that the adapter body is connected gas-tight with the base container at the first passage opening and the connection body at the second passage opening, an inverting frame connectable with the base container, with which the base container can be swiveled about a rotational axis (D), and a plurality of enclosure facilities, wherein each enclosure facility encompasses an interior volume into which the base container is comprises an enclosure container and an enclosure upper shell that are gas-tight connectable with one another, the plurality of enclosure facilities arranged such that at least one enclosure facility is stacked on top of another enclosure facility without the base container of one enclosure facility being in contact with another base container of an adjacent enclosure facility.

16. A device for storing and transporting bulk material, comprising:

a base container; and a connection body detachably connectable with the base container, wherein the base container and the connection body in a connected state form a scaling section with which the base container and the connection body are connected gas-tight with one another, wherein the sealing section comprises a first sealing contour formed by the base container and a second sealing contour formed by the connection body, which, in the connected state, are in gas-tight contact on one another, wherein the connection body comprises a filling connection, that can be closed gas-tight, for introducing and emptying of the bulk material, and to which a mating connection of a supplying and/or emptying facility is connected gas-tight, and an inverting frame connectable with the base container, with which the base container can be swiveled about a rotational axis (D), the supplying and/or emptying facility comprises a flexible tube which is either connected gas-tight with the connection body in the sealing section or which comprises the mating connection that is connected with the filling connection of the connection body, and a plurality of enclosure facilities, wherein each enclosure facility encompasses an interior volume into which the base container is placeable in between two clamping elements, wherein one clamping element covers a top of the base container and the other clamping element covers a bottom of the base container, and comprises an enclosure container and an enclosure upper shell that are gas-tight connectable with one another, the plurality of enclosure facilities arranged such that at least one enclosure facility is stacked on top of another enclosure facility without the base container of one enclosure facility being in contact with another base container of an adjacent enclosure facility.

17. A device for storing and transporting bulk material, comprising:

a base container; and a connection body detachably connectable with the base container, wherein the base container and the connection body in a connected state form a sealing section with which the base container and the connection body are connected gas-tight with one another, wherein the sealing section comprises a first sealing contour formed by the base container and a second sealing contour formed by the connection body, which, in the connected state, are in gas-tight contact on one another, wherein the connection body comprises a filling connection, that can be closed gas-tight, for introducing and emptying of the bulk material, and an adapter body with a first passage opening and a second passage opening, wherein the adapter body in a region of the first passage opening comprises a first sealing section comprising a first sealing contour and in a region of the second passage opening comprises a second sealing section comprising a second sealing contour such that the adapter body is connected gas-tight with the base container at the first passage opening and the connection body at the second passage opening, and a plurality of enclosure facilities, wherein each enclosure facility encompasses an interior volume into which the base container is placeable in between two clamping elements, wherein one clamping element covers a top of the base container and the other clamping element covers a bottom of the base container, and comprises an enclosure container and an enclosure upper shell that are gas-tight connectable with one another, the plurality of enclosure facilities arranged such that at least one enclosure facility is stacked on top of another enclosure facility without the base container of one enclosure facility being in contact with another base container of an adjacent enclosure facility.

18. A device for storing and transporting bulk material, comprising:

a base container; and a connection body detachably connectable with the base container, wherein the base container and the connection body in a connected state form a scaling section with which the base container and the connection body are connected gas-tight with one another, wherein the sealing section comprises a first sealing contour formed by the base container and a second sealing contour formed by the connection body, which, in the connected state, are in gas-tight contact on one another, wherein the connection body comprises a filling connection, that can be closed gas-tight, for introducing and emptying of the bulk material, and to which a mating connection of a supplying and/or emptying facility is connected gas-tight, and the supplying and/or emptying facility comprises a flexible tube which comprises the mating connection that is connected with the filling connection of the connection body, the filling connection and the mating connection form a double flap that can be opened when the filling connection and the mating connection are connected; and a plurality of enclosure facilities, wherein each enclosure facility encompasses an interior volume into which the base container is placeable in between two clamping elements, wherein one clamping element covers a top of the base container and the other clamping element covers a bottom of the base container, and comprises an enclosure container and an enclosure upper shell that are gas-tight connectable with one another, the plurality of enclosure facilities arranged such that at least one enclosure facility is stacked on top of another enclosure facility without the base container of one enclosure facility being in contact with another base container of an adjacent enclosure facility.

19. The device as in claim 1, further comprising a pallet onto which the plurality of enclosure facilities are stacked on top of at least one enclosure facility and on the side of another enclosure facility.

* * * * *